US005664777A

United States Patent [19]

Nordman et al.

[11] Patent Number: 5,664,777

[45] Date of Patent: Sep. 9, 1997

[54] ROTARY BALL STORAGE AND DISCHARGE DEVICE FOR A PINBALL GAME

[75] Inventors: Dennis P. Nordman, Chicago; Winston H. Schilling, Park Ridge; Edward F. Hicks, Palatine, all of Ill.

[73] Assignee: Williams Electronics Games, Inc., Chicago, Ill.

[21] Appl. No.: 564,492

[22] Filed: Nov. 29, 1995

[51] Int. Cl.[6] ..... A63F 7/30

[52] U.S. Cl. ..... 273/127 R; 273/129 R; 273/129 S; 273/119 R; 273/119 A; 273/118 R; 273/118 A; 273/121 R; 273/121 A

[58] Field of Search ..... 273/118–121, 123, 273/129 R, 129 S, 127 R, 127 B

[56] References Cited

U.S. PATENT DOCUMENTS

| | | | |
|---|---|---|---|
| 2,240,276 | 4/1941 | Williams et al. | 273/119 A |
| 5,120,059 | 6/1992 | Oursler | 273/121 A |
| 5,284,342 | 2/1994 | Tanzer et al. | 273/121 A |
| 5,322,283 | 6/1994 | Ritchie et al. | 273/121 A X |
| 5,326,103 | 7/1994 | Lund et al. | 273/121 A X |
| 5,356,141 | 10/1994 | Oursler et al. | 273/123 A X |
| 5,368,299 | 11/1994 | Driska | 273/119 A X |

*Primary Examiner*—Raleigh W. Chiu
*Attorney, Agent, or Firm*—Rudnick & Wolfe

[57] ABSTRACT

A play feature for a pinball game permits the storage of a number of game balls and release of the balls at high speed and in quick succession back onto the playfield for multiple ball play. A rotor element having a plurality of vertical vanes is disposed within a circular housing having a conical lip. The base and vanes of the rotor, together with the conical lip, define receptacles for receiving game balls. When a predetermined rotor speed is reached, the balls travel upwards on the conical lip and outward against an outer wall of the housing. The stored balls are conveyed successively to a discharge channel where they return to the play field at high speed.

17 Claims, 4 Drawing Sheets

ROTARY BALL STORAGE AND DISCHARGE DEVICE FOR A PINBALL GAME

FIELD OF THE INVENTION

The invention relates generally to amusement devices in the form of rolling ball games, and specifically to a play feature for a pinball game.

BACKGROUND OF THE INVENTION

Pinball games typically include an inclined playfield housed within a game cabinet and having mounted thereon a number of play features such as bumpers, ramps, targets, slots and the like. The play features influence the motion of the game ball, which is projected towards the features by flippers that are controlled by the player. Pinball games appeal to players because of the novel arrangement of the game features which make the game challenging and exciting to play. Generally, increased interaction between the player and the game results in increased appeal of the game to the game players. As players become more skilled at a particular game, however, the game loses its challenge and appeal. In order to maintain player interest and to satisfy the needs of the pinball game market, novel game features and arrangements are constantly required.

Typically, pinball games utilize a plurality of balls during game play which are directed by the player using flipper elements to engage various play features and targets on the game playfield. Multiple balls played simultaneously on the game playfield is more appealing than single ball play because of the heightened level of activity and the corresponding increase in the scoring capability.

A number of devices have been utilized in the prior art to facilitate multiple ball play. These include ball locks or ball poppers which retain a single ball on the playfield and release the ball at an appropriate time during play of a second ball. Other prior art devices permit the accumulation of more than one ball on the playfield and the release of a number of balls simultaneously at an appropriate time during game play. For example, U.S. Pat. No. 5,322,283 to Ritchie et al. describes a rotary ball receptacle that is capable of delivering a plurality of balls to the game playfield sequentially. A rotating wheel is mounted on the playfield and is provided with a number of ball receiving sockets. A game ball is conveyed to an unoccupied ball receiving socket on the wheel via a ramp that is situated above the wheel. A cup-shaped housing retains the balls in the ball receiving sockets as the wheel rotates. A series of optical switches are provided to index the wheel to ball receiving and ball discharging positions. Discharge of the balls from the wheel is controlled by a movable gate such that when the gate is raised the balls roll out of the cup and are discharged onto the playfield under the force of gravity. Because gravity is relied upon for the discharge of the balls from the wheel, there is necessarily some delay between the discharge of successive balls. Moreover, there is no appreciable velocity imparted to the balls as they are discharged from the device.

Thus, the degree of player appeal and game excitement is somewhat limited by the operating characteristics of prior art devices. None of the prior art attempts to improve the game have succeeded in providing quick, successive delivery of multiple game balls at an increased velocity in a way that provides visual excitement to the game player. It is accordingly an object of the invention to provide increased game appeal and excitement by introducing multiple game balls in rapid succession and at an increased speed back onto the game playfield.

SUMMARY OF THE INVENTION

The play feature embodying the present invention eliminates the disadvantages of prior art devices by providing a rotary ball storage and discharge device which is capable of discharging multiple game balls in rapid succession at an increased speed to other play features or back onto the game play field. A rotor element is mounted within a cup-shaped housing and partially defines a number of ball receptacles using a plurality of vane elements. The cup-shaped housing is provided with a conical lip portion which, together with the rotor body and vane elements, also defines the ball receptacles. Stored balls travel along the conical lip as the rotor spins at an idling speed. When the speed of the rotor is increased above the idling speed, the stored balls are accelerated and ride upwards on the conical lip portion eventually traveling outward onto a discharge surface in the housing and against an outer wall. The accelerated balls continue to travel on the discharge surface until they encounter a discharge chute or channel. The balls then travel out of the housing on back onto the playfield or to other play features. The device also enhances the visual effects of game play by storing balls while providing rotational activity on the game playfield, thereby increasing the excitement and appeal of the game.

DETAILED DESCRIPTION OF A PREFERRED EMBODIMENT OF THE INVENTION

Figure 1:
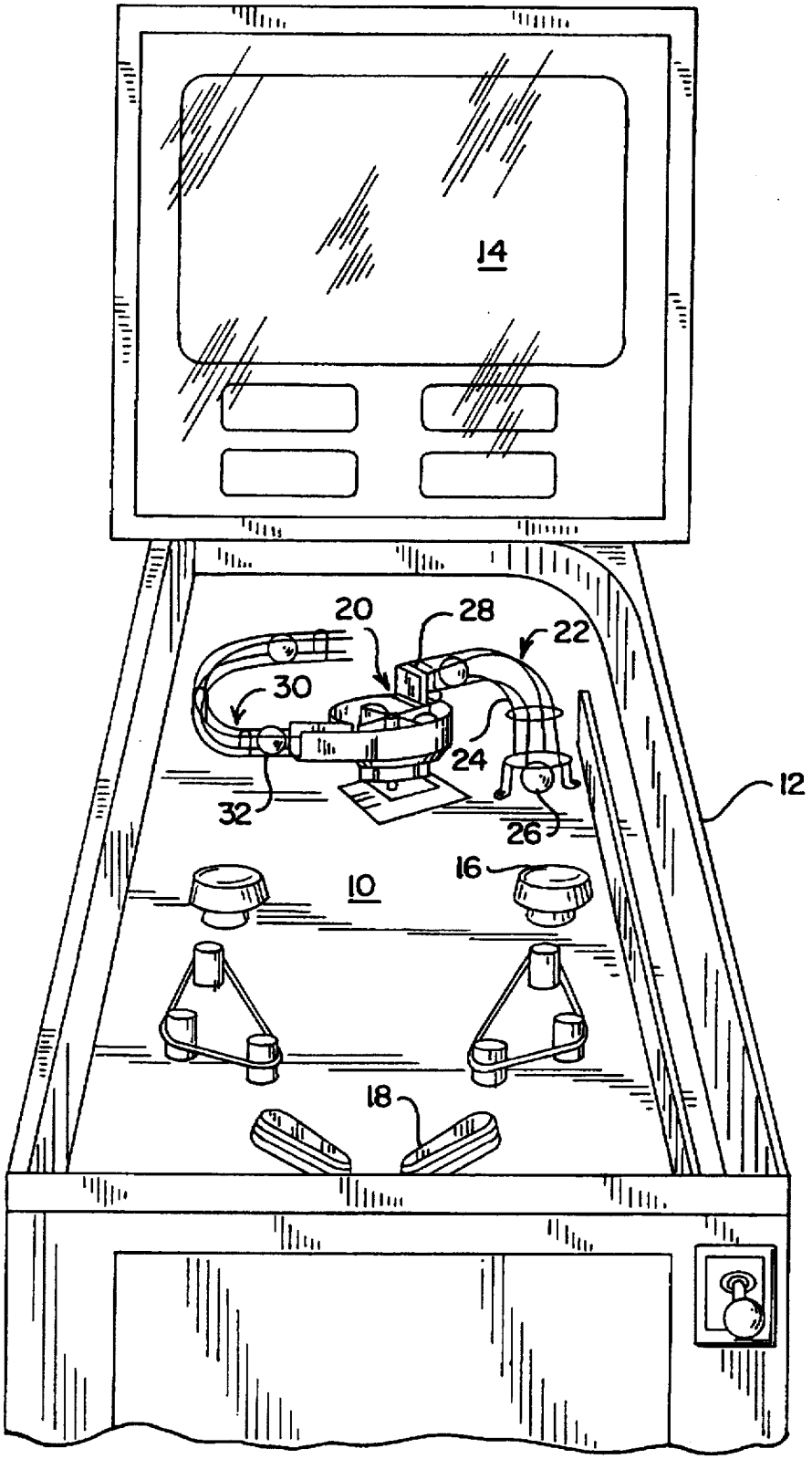
FIG. 1 is a front view of a typical pinball cabinet and playfield of a preferred embodiment of the present invention.

Referring to FIG. 1, a pinball playfield 10 is housed within a game cabinet 12. There is provided a backbox 14 for displaying the score and other game information to the player. Mounted on the playfield are a number of game features including bumper elements 16 and flippers 18 which are used by the player to control movement of the game ball. A rotary storage and discharge device 20 which embodies the present invention is mounted on the playfield. Ball input device 22 comprises a wire form 24 for delivering balls from the playfield to a position above the ball storage device. A ball popper (not shown) is disposed directly beneath the wire form and is used to elevate a game ball 26 within the wire form to a holding mechanism 28, which may comprise a magnet, for retaining the ball in place above the storage device for an appropriate amount of time as will be described below. A ball output device 30 is provided in the form of a wire form for conveying discharged balls 32 back onto the playfield or to another play feature.

Figure 2:
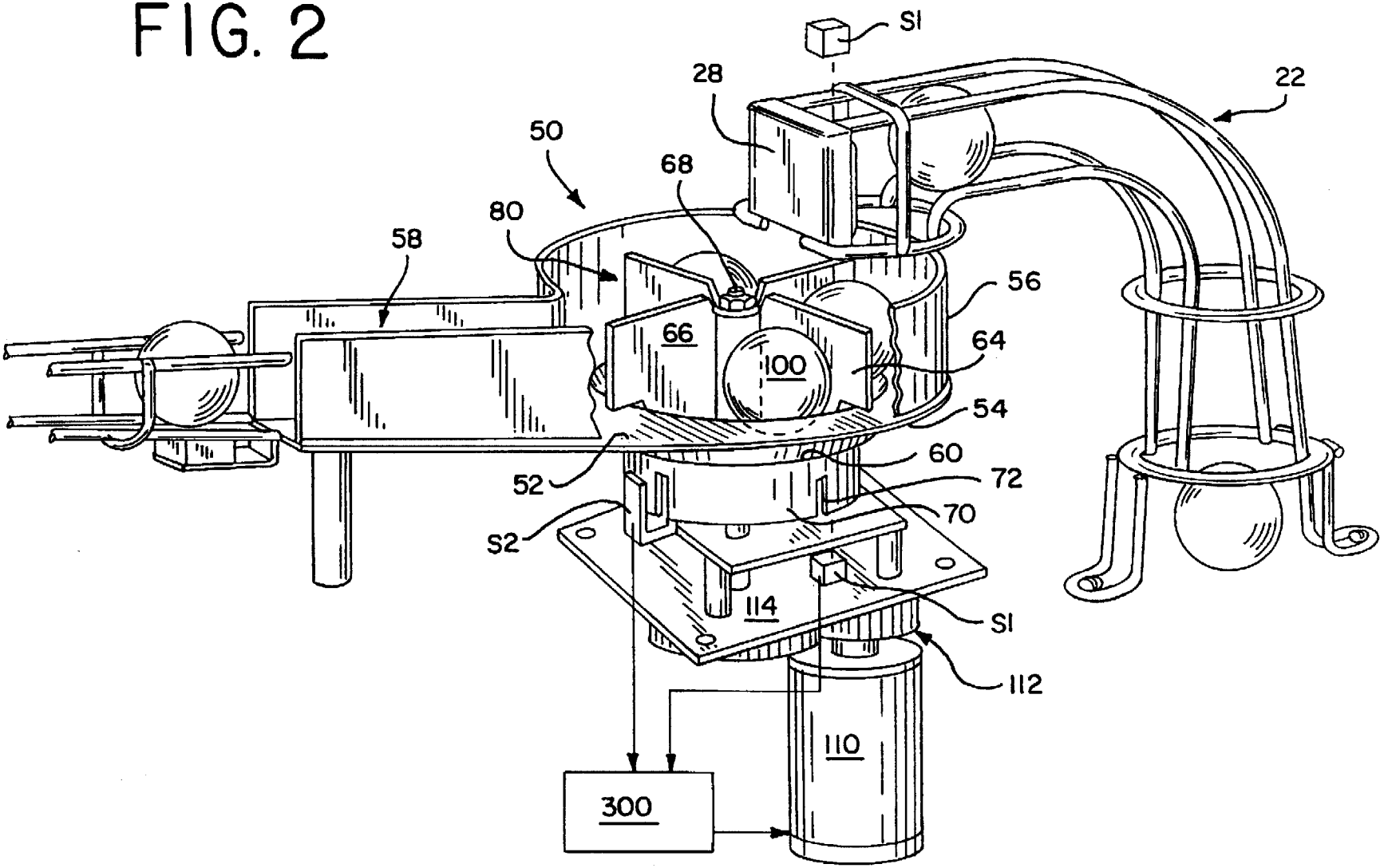
FIG. 2 is an isometric view of a preferred embodiment of the invention.

FIG. 2 illustrates the details of a preferred embodiment of the present invention. Cup-shaped housing 50, which may be constructed of metal, plastic, or any other suitable material, includes a bottom portion 52 having a planar circular discharge surface 54 and an outer peripheral wall 56 which extends upwards from the bottom portion 52. A substantial portion of the outer wall 56 is formed in a circular shape, except that the outer wall 56 extends into two generally parallel walls which form a ball discharge channel 58. The circular discharge surface 54 and the outer wall 56 form a discharge surface means for supporting the stored balls 100 for travel at a discharge speed.

The housing is provided with a conical lip portion 60 which extends downward and inward from the circular bottom surface 54 forming a circular aperture 62. Rotor 64 is disposed within aperture 62 and includes four vane elements 66 which extend radially outwardly from the center 68 of the rotor and are substantially perpendicular to the circular base portion 70 of the rotor. The rotor is provided with slots 72 on its base member and with an aperture 74 (FIG. 3) between each vane element. The function of the slots and apertures in the sensing and indexing operation of the rotor will be described below. Although four vane elements are depicted in the illustration of a preferred embodiment of the invention, it is to be understood that any number of vane elements may be provided on the rotor in order to define an equal number of ball-receiving spaces or receptacles 80. Ball receptacles 80 are defined by any two adjacent vane elements, a sector of the circular base 70 of the rotor disposed therebetween, and a segment of the conical lip 60 of the housing. The rotor base 70 and the conical lip 60 form an idling surface means for supporting stored balls for travel in a circular path at an idling speed.

While the rotor remains at rest or rotates at an idling speed with respect to the housing, the stored balls are held captive in the receptacles 80. When the speed of the rotor increases above the idling speed, the stored balls are accelerated as they travel in the circular path along the conical lip 60 and travel upwards on the conical lip 60 of the housing as they are pushed along by the rotor. The balls travel onto the circular discharge surface 54 and against the outer wall 56 of the housing. Once on the discharge surface, the balls do not make a complete revolution around the circular discharge surface because they are discharged from the storage device when they encounter the discharge channel 58. Thus, the stored balls do not enter the discharge surface 54 or the discharge channel 58 until they have achieved a high speed. This may occur in less than a single revolution of the rotor. The width of the planar discharge surface is preferably less than one-half of the diameter of the game balls in order to permit the balls resting on the discharge surface, when the rotor is stopped, to roll under their own weight back down into the ball receptacles.

Means for rotating the rotor is provided in the form of an electric motor 110 which is mounted beneath the playfield. The rotor element is driven through a transmission 112 which may comprise a series of gears or belts and pulleys for transmitting the rotational motion of the motor shaft to the rotor element The transmission members are mounted on a plate 114 which is secured to the playfield and on which the motor is mounted. The rotor 64, motor 110, and transmission 112 comprise a means for accelerating the stored balls 100.

Conventional optical switches, which comprise a light source, for generating a light beam, and a photoreceptor for sensing the light beam, are situated with respect to the rotor element to provide a sensing means for determining when a vacant space is beneath the ball input means 22. The sensing means provides information to a microprocessor, which controls the play of the game, the number of balls present in the storage device, and other information about the speed and position of the rotor which may be processed to affect the game play.

Figure 3:
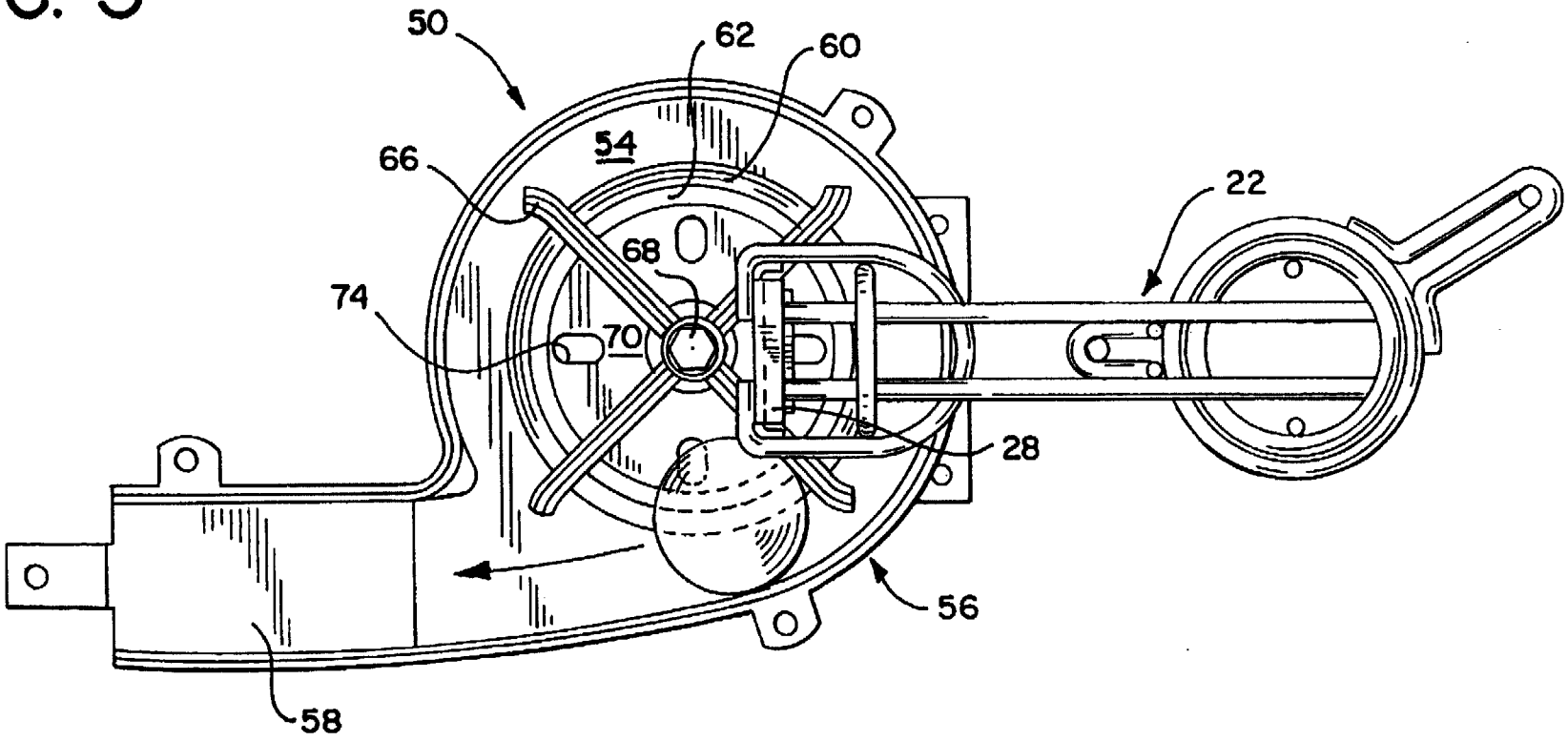
FIG. 3 is a top view of a preferred embodiment of the invention.

Referring to FIGS. 2 and 3, a first optical switch S1 is positioned such that the light path of switch S1 is aligned with the travel path of apertures 74 on the circular base portion 70 of the rotor. Optical switch S1 will thus be activated, or "on," when an aperture 74 is aligned with the light path. The "on" condition may therefore only occur when the corresponding receptacle 80 is not occupied by a stored ball.

The circular portion or base of the rotor is provided with a series of slots 72 whose angular position on the rotor base corresponds with that of the vanes 66. A second optical switch S2 is provided such that its light path may be aligned with the slots 72 of the rotor base 70. By appropriately positioning the optical switch with respect to the slots 72, a means is provided for detecting when a ball receptacle is positioned beneath ball input means 22. The ball being retained therein may then be released via instructions from the microprocessor after a vacant ball receptacle has been positioned beneath the ball holding device 28.

As successive game balls are delivered to ball input device 22, operation of the motor 110 and ball holding device 28 is controlled by the microprocessor 300 using signals from the optical switches S1 and S2 to index unoccupied ball receptacles to be filled by each game ball. The storage device thus functions in an indexing mode to place vacant ball receptacles beneath the ball holding device.

The storage device may also function in a counting mode, whereby the number of balls stored in the device may be determined at any time during game play. In the counting mode, the status of switch S1 is determined for each position of the rotor corresponding to alignment of a respective one of the slots 76 with the switch S2. In the case of a four-vaned rotor, the status of switch S1 is determined for each of the four rotational positions of the rotor corresponding to the alignment of each of the four indexing slots 72 with the switch S2. The number of times that an "off" status of switch S1 is determined after the rotor has rotated past the four rotational positions corresponds to the number of stored balls in the storage device. The determined number of balls may be utilized by the microprocessor 300 to control or vary game play based on the number of stored balls.

Figure 4A:
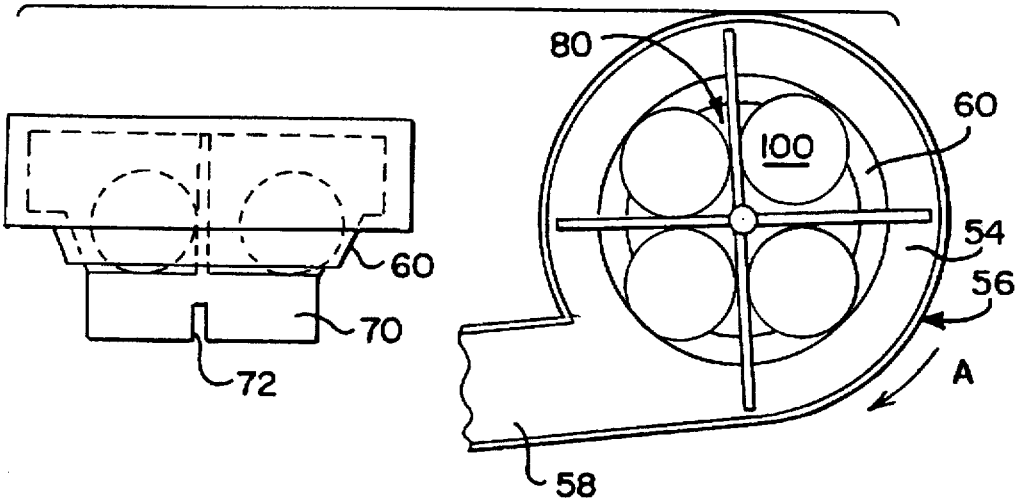
FIGS. 4A–4C illustrate the operation of a preferred embodiment of the invention.
Figure 4B:
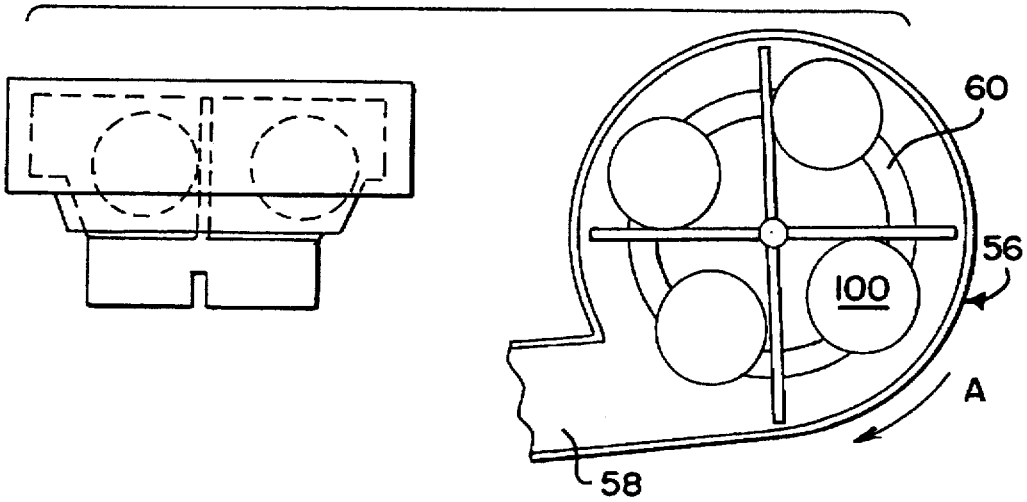
Figure 4C:
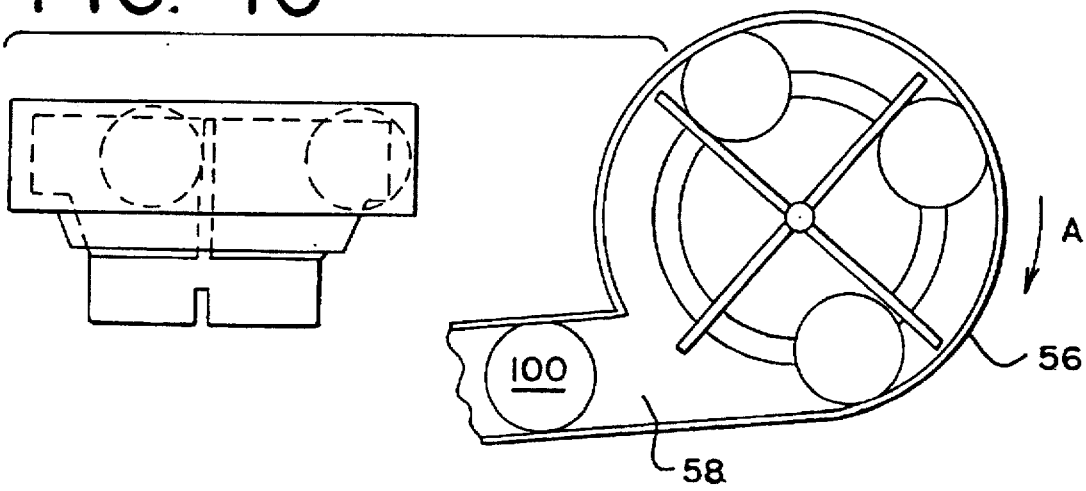

Discharge of the stored balls may occur when a combination of play features have been activated by the game player in order to achieve multiple ball play. When the game control logic indicates that the proper combination of play features have been activated, a discharge command is issued to the storage device which results in an increase in speed of the motor element and in the rotational motion of the rotor. The discharge operation of the storage device is illustrated in FIGS. 4A–4C. Referring to FIG. 4A, the rotor element is shown rotating at an idling speed in the direction of arrow A. The stored balls reside in the ball receptacles 80 and travel in a circular path along the conical lip 60. After the discharge command is issued to the storage device, the rotational speed of the rotor 64 increases. With reference to FIG. 4B, an increase in the speed of the rotor results in travel of the stored balls 100 upwards on the conical lip, and outward toward the discharge surface 54 and outer wall 56 of the housing member. Eventually, as shown in FIG. 4C, the balls ride along the outer wall 56 until they encounter the output channel 58. The balls are then conveyed outward in rapid succession to a ramp or wire form channel which may lead back onto the game playfield or to another play feature.

Those of ordinary skill in the art will understand that the discharge speed of the stored balls may be predetermined by the proper configuration of the conical lip portion on the housing member. For example, if the conical lip portion assumes a steeper angle with respect to the vertical, a higher ball speed will be required before the balls surmount the conical lip portion. Thus, the balls will exit the storage device at a greater speed.

There has thus been described a novel and improved play feature for a pinball game which provides increased appeal to game players and increased play action. While a preferred embodiment of the invention has been described above and with respect to the drawings, those of ordinary skill in the art will appreciate that numerous changes in the details and construction of the play feature can be made without departing from the spirit and the scope of the invention as set forth in the claims that follow.

What is claimed is:

1. A play feature for a pinball game having an inclined playfield supporting a plurality of game balls thereon, said play feature comprising:

(a) a circular housing comprising:

(i) an idling surface for receiving and supporting game balls for movement in a circular path at an idling speed;

(ii) a discharge surface disposed above said idling surface for receiving and supporting game balls for movement out of said housing at a discharge speed greater than the idling speed;

(b) means for accelerating game balls from said idling speed to said discharge speed; and (c) means for delivering game balls to said housing;

whereby balls delivered to said housing remain therein until accelerated to said discharge speed.

2. The play feature of claim 1, wherein said means for accelerating comprises:

a rotor element disposed within said housing and having a circular base and a plurality of radial vanes extending substantially perpendicular thereto; and wherein said play feature further comprises means for rotating said rotor element.

3. The play feature of claim 2, wherein said idling surface comprises a conical lip extending downward from said discharge surface, said conical lip, said circular base and said vanes forming a plurality of ball receptacles, each for receiving a game ball.

4. The play feature of claim 2, wherein said means for rotating comprises an electric motor.

5. The play feature of claim 3, wherein said means for delivering game balls comprises a wire form disposed above said housing.

6. The play feature of claim 5, further comprising rotor position control means for positioning an unoccupied one of said ball receptacles with respect to said means for delivering to permit delivery of one of said game balls to said unoccupied one of said receptacles.

7. The play feature of claim 5, wherein said means for delivering comprises a magnetic ball holder for retaining one of said game balls in a holding position with respect to said rotor elements.

8. The play feature of claim 7, wherein said magnetic ball holder is provided with magnetic control means for selectively applying magnetic force to said one of said game balls.

9. The play feature of claim 6, wherein said rotor element positioning control means comprises:

ball sensing means for sensing the presence or absence of a ball in each of said receptacles and generating a first signal in response thereto;

rotor position sensing means for sensing the rotational position of said receptacles with respect to said ball input means and generating a second signal in response thereto; and control means for generating a control signal to said means for rotating said rotor element in response to said first and said second signals.

10. The play feature of claim 9, wherein said ball sensing means comprises:

a plurality of apertures formed in said base portion of said rotor element, one of said apertures being disposed on each of said ball receptacles and covered when a ball is located in a respective one of said receptacles;

an first optical switch positioned with respect to said rotor element such that said apertures pass within a light path of said first optical switch as said rotor element rotates.

11. The play feature of claim 10, wherein said rotor position sensing means comprises:

a plurality of slots formed in said base portion, one of said slots being disposed beneath each one of said vanes;

a second optical switch positioned with respect to said rotor such that said slots pass within a light path of said second optical switch as said rotor element rotates.

12. The play feature of claim 6, wherein said control means comprises a microprocessor.

13. The play feature of claim 1, wherein said idling surface comprises a conical lip on said housing.

14. The play feature of claim 13, wherein said discharge surface comprises:

a planar circular bottom on said housing, said conical lip extending from said bottom and forming a circular recess in said housing; and an outer wall disposed about the periphery of said circular bottom and extending perpendicular thereto.

15. The play feature of claim 14, wherein said conical lips is formed integrally with said bottom of said housing.

16. The play feature of claim 14, wherein said circular bottom is of a width which is less than half of the diameter of said game balls whereby said stored balls roll under their own weight off of said circular bottom when said rotor element is at rest.

17. A play feature for a pinball game having an inclined playfield supporting a plurality of game balls thereon, said play feature comprising:

(a) a cup-shaped housing including a circular ball support surface, a conical lip extending downwardly and inwardly from said circular support surface, and a wall extending partially about the circumference of the ball support surface;

(b) a ball input chute communicating with said housing;

(c) a ball output chute communicating with said housing; and (d) a rotor mounted to said housing and having at least one radial vane element for pushing game balls in a circular path within said housing;

wherein acceleration of said rotor from a first predetermined speed to a second predetermined speed causes said game balls to travel over said conical lip, outward against said outer wall and through said ball output chute.

* * * * *